US006782660B2

(12) United States Patent
Takada et al.

(10) Patent No.: US 6,782,660 B2
(45) Date of Patent: Aug. 31, 2004

(54) AUTOMATIC DOOR SENSOR

(75) Inventors: Yasuhiro Takada, Ohtsu (JP); Akihiro Ikeuchi, Ohtsu (JP)

(73) Assignee: Optex Co., Ltd., Shiga-Ken (JP)

( * ) Notice: Subject to any disclaimer, the term of this patent is extended or adjusted under 35 U.S.C. 154(b) by 74 days.

(21) Appl. No.: 10/132,836

(22) Filed: Apr. 26, 2002

(65) Prior Publication Data

US 2002/0157314 A1 Oct. 31, 2002

(30) Foreign Application Priority Data

Apr. 27, 2001 (JP) ..... 2001-131187

(51) Int. Cl.[7] ..... E05F 15/20
(52) U.S. Cl. ..... 49/25
(58) Field of Search ..... 250/221; 340/555, 340/556; 49/25, 26, 28

(56) References Cited

U.S. PATENT DOCUMENTS 4,733,081 A * 3/1988 Mizukami ..... 250/221
4,823,010 A * 4/1989 Kornbrekke et al. ..... 49/25
4,967,083 A * 10/1990 Kornbrekke et al. ..... 49/25
5,410,149 A * 4/1995 Winston et al. ..... 250/221
6,304,178 B1 * 10/2001 Hayashida ..... 340/545.1

FOREIGN PATENT DOCUMENTS

JP 4-1384 * 4/1992 ..... 49/25
JP 6-138253 5/1994
JP 2000-320243 11/2000

* cited by examiner

*Primary Examiner*—Jerry Redman
(74) *Attorney, Agent, or Firm*—Wenderoth, Lind & Ponack, L.L.P.

(57) ABSTRACT

Auxiliary sensors 51 and 52 are disposed on exterior and interior side surfaces 31 and 32 of a transom 3. The sensors 51 and 52 have detection areas A1, A2, B1 and B2 which extend through the doorway 2 and which cross each other in a space vertically above a track 10. While detection signals are produced by both auxiliary sensors 51 and 52, the door is kept open. If detection signals are produced from only one of the auxiliary sensors 51 and 52 uninterruptedly for a predetermined time, the door closing action is allowed to start.

17 Claims, 10 Drawing Sheets

(a)

(b)

(a)

(b)

AUTOMATIC DOOR SENSOR

BACKGROUND OF THE INVENTION

The present invention relates to an automatic door sensor. In particular, the present invention concerns measures to ensure an accurate detection operation of an object (e.g. a human body) located on the track of an automatic door, thereby enhancing the reliability of the opening and closing action of the automatic door.

Usually, with respect to an automatic door which opens and closes along a track, object detection ranges are set on the interior and the exterior of its doorway. Objects in these detection ranges are detected by an activation sensor. The activation sensor generally includes sensor mats, ultrasonic sensors and pyroelectric sensors. On detecting entry of an object into any of the detection ranges, the activation sensor performs an ON operation to open the door.

In addition to this activation sensor, an auxiliary sensor is disposed in the vicinity of the track of the door, between the interior and exterior detection ranges. As disclosed in Japanese Patent Laid-open Publication No. 2000-320243, for example, the auxiliary sensor makes use of light beams (e.g. infrared rays). Typically, the auxiliary sensor can be classified into three types.

The first type of auxiliary sensor is shown in FIG. 8. Beam sensors are mounted on a pair of posts 94 which stand on both sides of a doorway 93. Transmitters 95 on one of the posts are located face to face with receivers 96 on the other post (the structure in FIG. 8 employs two beam sensors, each of which is composed of a transmitter 95 and a receiver 96). In each sensor, when a light beam is emitted from the transmitter 95 towards the receiver 96 and interrupted by a person or the like, the receiver 96 fails to receive the light beam. The sensor regards this condition as the presence of an object near the track of doors 90. Based on this recognition, the auxiliary sensor holds the doors 90 open, even when the activation sensor is turned off.

The second type of auxiliary sensor is shown in FIG. 9. A transmitter 95 and a receiver 96 are mounted at the end of a first door 91, whereas mirrors 97 are provided at the end of a second door 92 in order to reflect the light emitted from the transmitter 95 back to the receiver 96. Similar to the first prior art structure, when a light beam is emitted from the transmitter 95 and interrupted by a person or the like, the receiver 96 fails to receive the light beam. The sensor regards this condition as the presence of an object near the track of the doors 91, 92. Based on this recognition, the auxiliary sensor holds the doors 91 and 92 open, even when the activation sensor is turned off. Such an auxiliary sensor is disclosed, for example, in Japanese Patent Laid-open Publication No. H6-138253.

The third type of auxiliary sensor is shown in FIG. 10. An ultrasonic sensor 99 is built in a transom 98 above a doorway 93 and produces ultrasonic waves to and around the track of doors 90. In FIG. 10, the detection area of the ultrasonic sensor 99 is indicated by a dash-dotted line. According to this sensor, a sensor signal from the ultrasonic sensor 99 is considered valid only when the doors 90 are fully open. On the other hand, when the doors 90 are fully closed or in the course of closing, any sensor signal from the ultrasonic sensor 99 is considered invalid. This principle prohibits the sensor 99 from wrongly detecting the closing doors 90 as a person or other object. Thus, the doors 90 are not opened at unnecessary occasions. Such an auxiliary sensor is disclosed, for example, in Japanese Utility Model Laid-open Publication No. H1-112287.

However, these conventional sensors have various problems as mentioned below.

As for the first type of auxiliary sensor, the transmitters 95 and the receivers 96 are mounted on the posts 94. Hence, this sensor is unable to direct the beams in a space vertically above the track, and may fail to detect an object which lies on the track. In other words, if an object locates at a position depicted by an imaginary line i in FIG. 8, the sensor cannot detect the object, which is high enough for the height position of the beams but which fails to block the beams. Furthermore, installation of the transmitters 95 and the receivers 96 involves a complicated wiring arrangement through the inside of the posts 94. Particularly, if a plurality of beam sensor sets are employed, the wiring arrangement is extremely complex and requires higher installation costs.

The second type of auxiliary sensor is capable of directing the beam in a space vertically above the track, and thus capable of detecting an object which lies on the track. However, installation of this sensor is more complex than that of the first type of sensor, because the transmitter 95 and the receiver 96 are mounted on the door 91, with the wiring led through the inside of the door 91.

The third type of auxiliary sensor can solve the problems concerning the first and second types of sensors. Nevertheless, the third type of sensor may make a wrong detection, owing to a change in the floor condition (e.g. a change of the reflection factor). For example, if the floor condition turns from dry to wet due to rainfall or the like, the sensor may wrongly recognize the change of the floor condition as the entry of a person. In this case, the doors 90 are left open even when no person is present on the track of the doors 90.

As mentioned above, none of the conventional automatic door sensors can perform fully reliable object detection operations in the vicinity of the track of the doors 90. Therefore, there has been considerable demand for an automatic door sensor which can ensure satisfactory reliability in object detection.

The present invention is made in view of such problems and demands. An object of the present invention is to provide an automatic door sensor which can accurately detect an object located in a predetermined area which is defined on or above the track of an automatic door, thereby enhancing the reliability of the opening and closing action by the automatic door.

SUMMARY OF THE INVENTION

In order to achieve the above object, the present invention employs a pair of sensors whose detection areas cross each other on the track or in a space vertically above the track. With such sensors, the recognition of an object (e.g. a person) that in located on the track takes place when both of the sensors produce detection signals. Thus, the present invention improves reliability in an object detection operation on the track. Besides, the crossed detection areas are utilized in determining the presence or absence of an object (e.g. a person). The resulting structure is less susceptible to adverse influences which may be caused, for example, by a change of the reflection factor on the floor.

Specifically, the present invention supposes an automatic door sensor which detects the presence or absence of an object on a track of an automatic door. This automatic door sensor comprises a pair of sensor means for detecting an object and producing an object detection signal, if the object is located within a detection area of each sensor means which is defined in a surrounding area of a doorway. The detection areas of the respective sensor means partially cross each other on the track or in a space vertically above the track as viewed from an extension direction of the track. The automatic door sensor also comprises control means which is capable of receiving the object detection signal produced by each of the sensor means. This control means recognizes the presence of an object on the track and keeps the door in an open state only when the control means receives the object detection signals from both of the sensor means.

According to this feature, when an object (e.g. a person) is present on the track, it means that the object locates in a region where the detection area of one of the sensor means crosses that of the other sensor means. In this situation, object detection signals are produced by both of the sensor means. On receiving the object detection signals from both sensor means, the control means keeps the door open, judging that an object is present on the track of the door. In the case of a conventional auxiliary sensor (e.g. the ultrasonic sensor shown in FIG. 10), the sensor may make a misoperation, for example, when a reflection factor on the floor changes. By contrast, in order to detect an object, the sensor of the present invention utilizes a region where the detection areas of both sensor means cross each other. To give an example, even if the detection area of either sensor means may become wet due to rainfall or the like, the sensor of the present invention does not determine the presence of an object as long as the condition of the other detection area remains unchanged. Consequently, this sensor is capable of properly distinguishing a change of the reflection factor on the floor from the presence of an object, and thus capable of conducting an accurate object detection operation.

With respect to the control operation of the control means, the control means is arranged to start an action for closing the door if the control means receives the object detection signal from only one of the sensor means uninterruptedly for a predetermined time. According to this feature, if the control means receives the object detection signal from only one of the sensor means for a predetermined continuous time, the control means recognizes the presence of an object which is located off the track and in its vicinity, but judges that there is no object on the track. According to this judgement, the control means closes the door, because the door may be closed without problem when an object (e.g. a person) is not on the track and is located in its vicinity. Thus, it is possible to prevent the door from being kept open unnecessarily for a long time.

As for the manner of disposing the respective sensor means, each of the sensor means is disposed on a transom at the doorway. Regarding the manner of defining the detection area, the detection area of each sensor means is defined by a region which extends through the doorway across the track and which reaches a space on the other side of the door.

In this respect, each of the sensor means may be disposed on a side surface or a bottom surface of the transom. Also, each sensor means may be mounted on a ceiling surface if the transom is integrated into the ceiling surface.

In addition, the detection area can be defined in the following two ways. Firstly, the detection area of one of the sensor means may cross that of the other sensor means, as viewed from a front of the door. Secondly, the detection area of one of the sensor means may not cross that of the other sensor means, as viewed from a front of the door.

BRIEF DESCRIPTION OF THE DRAWINGS

FIG. 5(*b*) is a front view of the automatic door.

DESCRIPTION OF THE PREFERRED EMBODIMENTS

Embodiments of the present invention are hereinafter described with reference to the drawings.

First Embodiment

In the first embodiment, an automatic door sensor of the present invention is applied as an auxiliary sensor for detecting an object (e.g. a person) which is located on the track of an automatic door.

Figure 1:
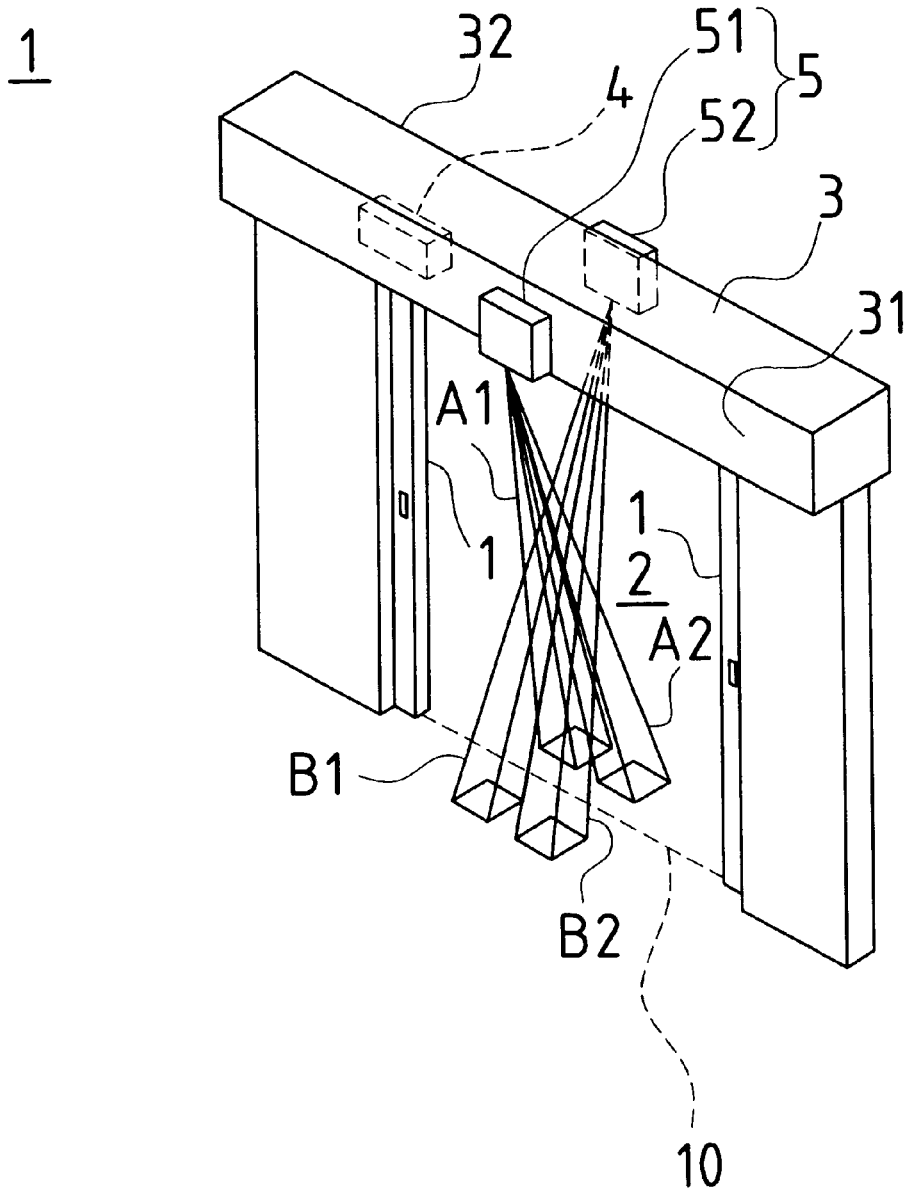
FIG. 1 is a perspective view showing an automatic door and a surrounding area around a doorway of this automatic door in a first embodiment of the invention.
Figure 2:
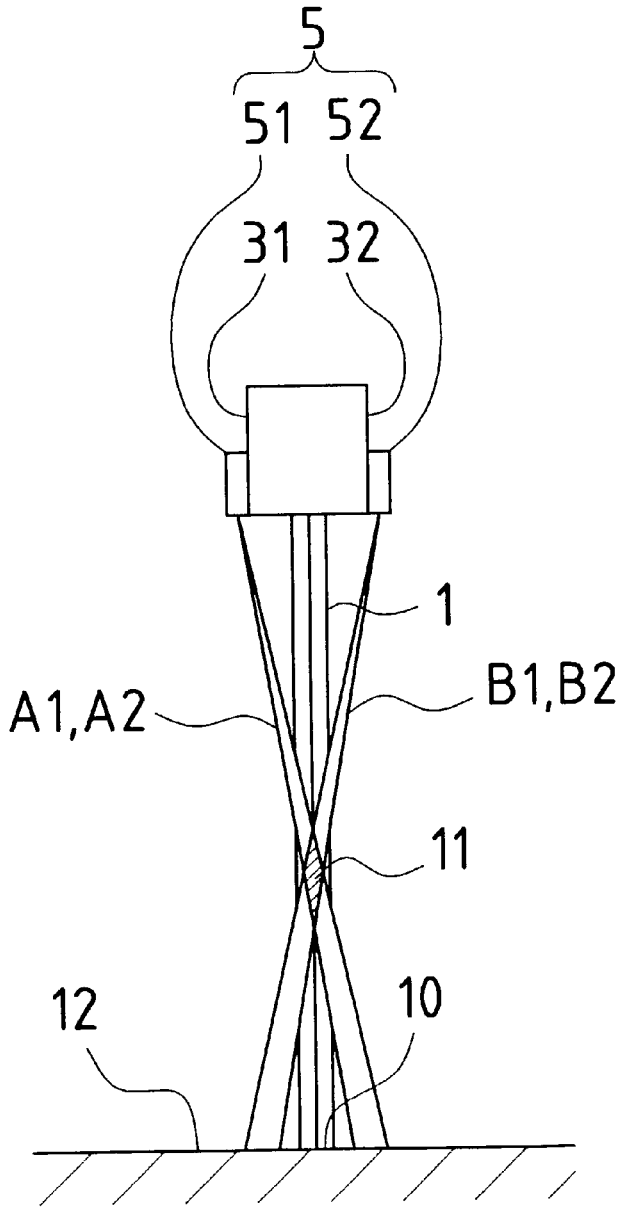
FIG. 2 is a side view of the surrounding area around the doorway.

FIG. 1 is a perspective view showing an automatic door and a surrounding area around a doorway of the automatic door in the first embodiment. FIG. 2 is a side view of the surrounding area around the doorway. As illustrated, the automatic door concerning this embodiment is a bi-parting door which comprises two door segments 1 movable in opening and closing directions (movable in horizontal directions) along a track 10 (shown by a broken line in FIG. 1). A detection area of an activation sensor (not shown) is set on the exterior (on the left in FIG. 2) and the interior (on the right in FIG. 2) of a doorway 2. When a person or the like enters the detection area, the activation sensor detects its presence and produces an object detection signal. This signal is sent to an automatic door controller 4 housed in a transom 3. On receiving the object detection signal, the automatic door controller 4 starts a driving motor of a door opening/closing mechanism (not shown) in order to open the door segments 1. Since the opening and closing mechanism of the door segments 1 is well known in the art, its description is omitted herein. As for the activation sensor, a common ultrasonic or pyroelectric sensor is adoptable.

The transom 3 has an auxiliary sensor 5 mounted thereon, which is the feature of the present embodiment as detailed below.

The auxiliary sensor 5 comprises, as sensor means, a first auxiliary sensor 51 which is disposed on a side surface 31 on one side of the transom 3 (on the left in FIG. 2), and a second auxiliary sensor 52 which is disposed on a side surface 32 on the other side of the transom 3 (on the right in FIG. 2). These auxiliary sensors 51 and 52 comprise an infrared sensor which emits infrared rays to a surrounding area of the track 10 of the door segments 1 or an ultrasonic sensor which emits ultrasonic waves in the same manner. When a human body or the like enters any of the predetermined detection areas, the sensor detects a change in reflected waves and produces a detection signal.

The feature of the present embodiment resides in detection areas to be covered by the auxiliary sensors 51 and 52. The characteristic detection areas are described below.

For the first auxiliary sensor 51 disposed on the exterior side surface 31 of the transom 3 (on the left in FIG. 2), detection areas are oriented from the exterior to the interior. In FIG. 1 and FIG. 2, these detection areas are indicated by A1 and A2. Thus, the detection areas A1 and A2 of the first auxiliary sensor 51 extend from the exterior and reach the interior through the doorway 2. The first auxiliary sensor 51 has an optical system as well (not shown). A plurality of detection areas A1, A2 (two in this embodiment) are set side by side in the extension direction of the track 10. While the first auxiliary sensor 51 receives reflected waves from these detection areas, if the change amount of reflected waves exceeds a predetermined threshold value in at least one of the detection areas A1 and A2, the sensor 51 produces a detection signal.

For the second auxiliary sensor 52 disposed on the interior side surface 32 of the transom 3 (on the right in FIG. 2), detection areas are oriented from the interior to the exterior. In FIG. 1 and FIG. 2, these detection areas are indicated by B1 and B2. Thus, the detection areas B1 and B2 of the second auxiliary sensor 52 extend from the interior and reach the exterior through the doorway 2. The second auxiliary sensor 52 has an optical system as well (not shown). A plurality of detection areas B1 and B2 (two in this embodiment) are set side by side in the extension direction of the track 10. While the second auxiliary sensor 52 receives reflected waves from these detection areas, if the change amount of reflected waves exceeds a predetermined threshold value in at least one of the detection areas B1 and B2, the sensor 52 produces a detection signal.

As described above, the detection areas A1, A2, B1 and B2 of the auxiliary sensors 51 and 52 are defined through the doorway 2. It should be noted that the detection areas A1 and A2 of the first auxiliary sensor 51 are set face to face with the detection areas B1 and B2 of the second auxiliary sensor 52, opposed in a direction orthogonal to the extension direction of the track 10. Hence, at the doorway 2, the detection areas A1 and A2 of the first auxiliary sensor 51 partially cross the detection areas B1 and B2 of the second auxiliary sensor 52. In FIG. 2, the cross areas 11 are indicated by shaded lines. In other words, the cross areas 11 include two regions: a first region where the detection area A1 of the first auxiliary sensor 51 crosses the detection area B1 of the second auxiliary sensor 52 and a second region where the detection area A2 of the first auxiliary sensor 51 crosses the detection area B2 of the second auxiliary sensor 52. The cross areas 11 are defined in a space vertically above the track 10, with a predetermined distance from a floor 12. The distance (height) from the floor 12 to the cross areas 11 is, for example, in the range of 300 mm to 600 mm, but should not be limited to this range. As for the height dimension of the cross areas 11, the height dimension can be changed by optionally setting the angle of the detection areas A1, A2, B1 and B2 relative to the floor 12 (e.g. by setting the irradiation angle of infrared rays, etc.). To be more specific, the height dimension of the cross areas 11 is extended by setting a greater angle relative to the floor 12. On the other hand, the height dimension of the cross areas 11 is reduced by setting a smaller angle relative to the floor 12.

Figure 3:
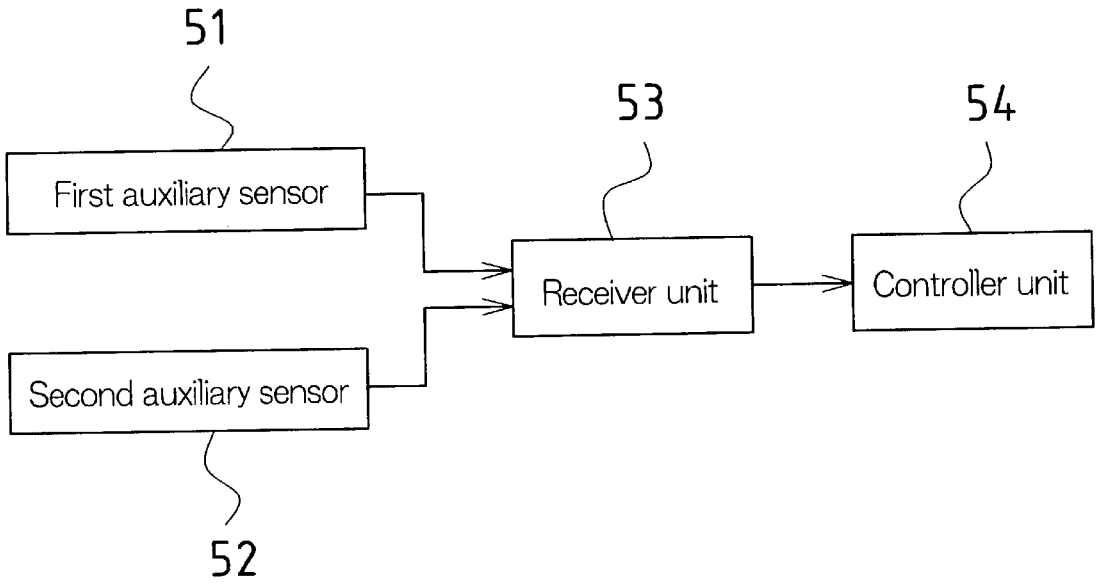
FIG. 3 shows a general structure of control blocks in an auxiliary sensor.

FIG. 3 shows a general structure of control blocks in the auxiliary sensor. As illustrated, the auxiliary sensor 5 further comprises a receiver unit 53 which is capable of receiving detection signals from the auxiliary sensors 51 and 52, and a controller unit 54, as control means, which controls the opening/closing action of the door segments 1, based on a received signal which is supplied from the receiver unit 53. Specifically, based on the transmission timing of detection signals produced by the auxiliary sensors 51 and 52, the controller unit 54 distinguishes whether an object (e.g. a person) is located on the track 10 or whether it is off the track 10 and situated in the vicinity thereof. According to this distinction, the controller unit 54 controls the opening and closing action of the door segments 1.

Figure 4:
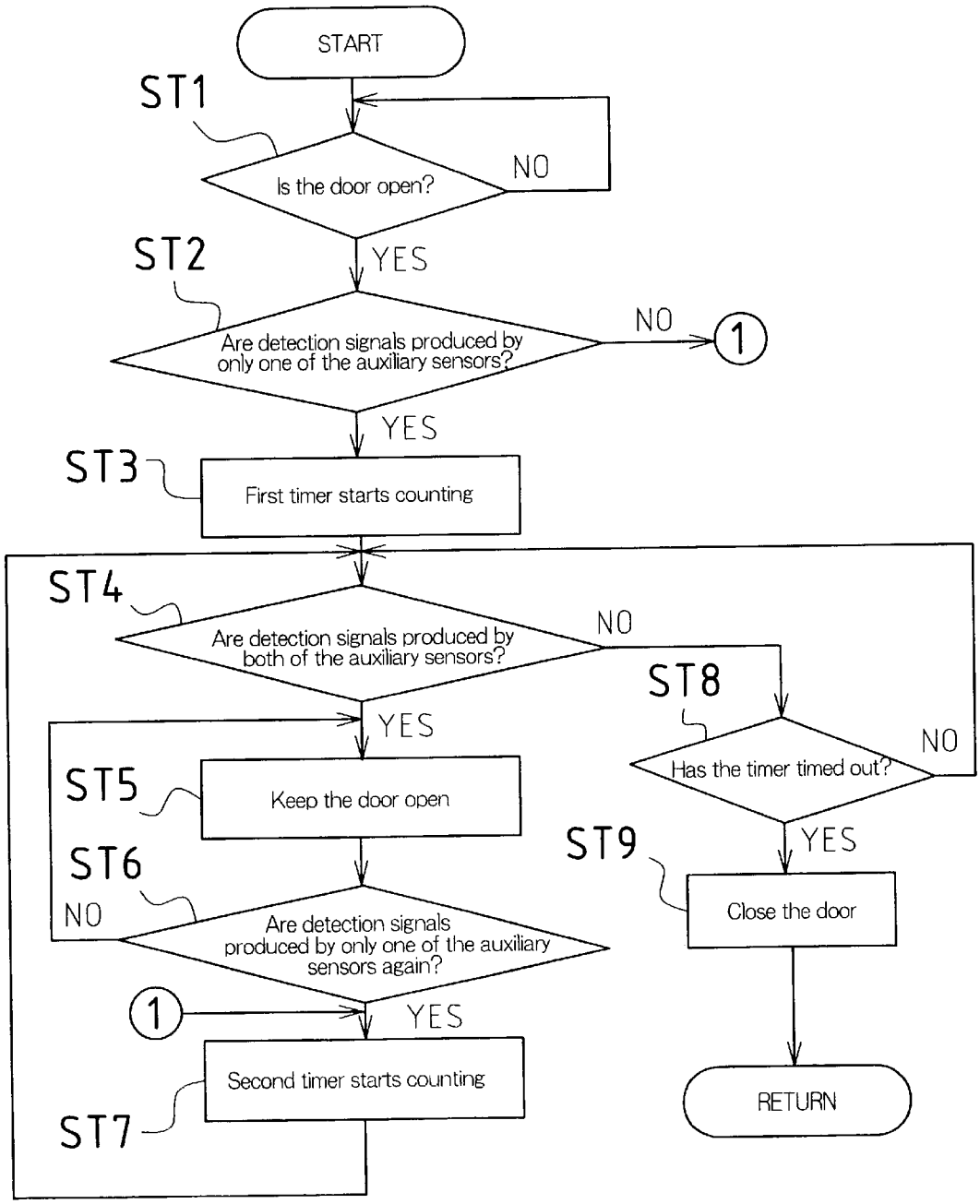
FIG. 4 is a flowchart which describes a series of operations for controlling the opening and closing action of the door segments.

Now, referring to the flowchart in FIG. 4, the description mentions how the controller unit 54 performs a series of operations for controlling the opening and closing action of the door segments 1.

To begin with, in the step ST1, the unit 54 judges whether the door segments 1 are open under the operation of the activation sensors. If the door segments 1 are not open, detection signals produced by the auxiliary sensors 51 and 52 are cancelled. Accordingly, it is possible to avoid a misoperation which occurs when the auxiliary sensors 51 and 52 detect the door segments 1. In addition, while the automatic door is switched on, the auxiliary sensors 51 and 52 observe the condition of the floor 12 within the detection areas A1, A2, B1 and B2.

If the door segments 1 are open in the step ST1, the unit 54 follows YES to the step ST2 and judges whether detection signals are produced by only one of the auxiliary sensors 51 and 52. Namely, the step ST2 is to judge whether a person or the like has entered the vicinity of the track 10 (the detection areas covered by only one of the auxiliary sensors 51 and 52). If the detection signals come from only one of the auxiliary sensors (follow YES), then a first timer is allowed to start counting (step ST3). The first timer is provided in the controller unit 54 and arranged to time out after a predetermined time (e.g. 5 seconds). After the first timer starts the count, the controller unit 54 judges whether detection signals are produced by both of the auxiliary sensors 51 and 52 (step ST4). The situation where detection signals are produced by both auxiliary sensors 51 and 52 is understood to indicate the presence of a person or the like at the cross areas 11. In other words, the detection operation in the step ST4 is focused on the cross areas 11, thereby judging whether the person or the like has advanced onto the track 10. If the process follows YES, the door segments 1 are kept in the open state, based on the judgement that a person or the like is located on the track 10 (step ST5).

Further proceeding to step ST6, the unit 54 judges whether detection signals are produced by only one of the auxiliary sensors 51 and 52 again. Namely, the step ST6 judges whether the person or the like has moved away from the track 10 to the vicinity of the track 10 (i.e. to the detection areas covered by only one of the auxiliary sensors 51 and 52). If detection signals are produced by only one of the auxiliary sensors 51 and 52 again (follow YES), then a second timer is allowed to start counting (step ST7). The second timer is arranged to time out after a predetermined time (e.g. 3 seconds). After the second timer starts the count, the process returns to the step ST4, so as to judge whether detection signals are produced by both of the auxiliary sensors 51 and 52 again. This process judges whether the person or the like that once moved away from the track 10 has returned onto the track 10.

Regarding the step ST4, if the person or the like that once moved away from the track 10 has not returned onto the track 10, he/she may have gone away from the vicinity of the track 10, or he/she may be off the track 10 and stay in its vicinity. In this case, follow NO and wait for the first or second timer to time out (step ST8). In other words, the step ST8 judges whether the person or the like does not return onto the track 10 for a predetermined continuous time. Once the timer ends its count, a door closure signal is transmitted to the automatic door controller 4 in order to close the door segments 1 (step ST9).

Incidentally, after the process follows YES in the step ST2, the person or the like may have stopped at the same place and have not advanced onto the track 10, or he/she may have moved away from the door segments 1. In this case, the first timer is allowed to start counting in the step ST3, and, in the meantime, the process goes to the step ST4 and the step ST8. Finally, when the first timer times out, the unit 54 closes the door segments 1.

Further, while the door segments 1 are open, no person or the like might enter the detection areas A1, A2, B1 and B2 of the auxiliary sensors 51, 52. Then the procedure follows the steps ST2, ST7, ST4 and ST8. Finally, when the second timer times out, the unit 54 closes the door segments 1.

As detailed above, the first embodiment designs the detection areas A1, A2, B1 and B2 of the auxiliary sensors 51 and 52 to cross each other in a space vertically above the track 10, and utilizes the cross areas 11 for detection of an object (e.g. a person). As described above, in the case where the floor 12 includes the detection areas A1, A2, B1 and B2 covered by the auxiliary sensors 51 and 52, it is supposed, for example, that either side of the floor 12 becomes wet by rainfall or the like. Even in such circumstances, the sensor does not determine the presence of an object, as far as the condition of the other side of the floor 12 remains unchanged. Consequently, this auxiliary sensor is capable of detecting an object while properly distinguishing a change of the reflection factor on the floor 12 from the presence of an object.

Besides, if detection signals are produced by only one of the auxiliary sensors 51 and 52 uninterruptedly for a predetermined time, the sensor is designed to close the door segments 1. As a result, it is possible to prevent the door from being kept open unnecessarily for a long time.

Second Embodiment

In the second embodiment, the detection areas to be covered by the auxiliary sensors 51 and 52 are modified. Hence, the description of the second embodiment concentrates on the detection areas only.

Figure 5:
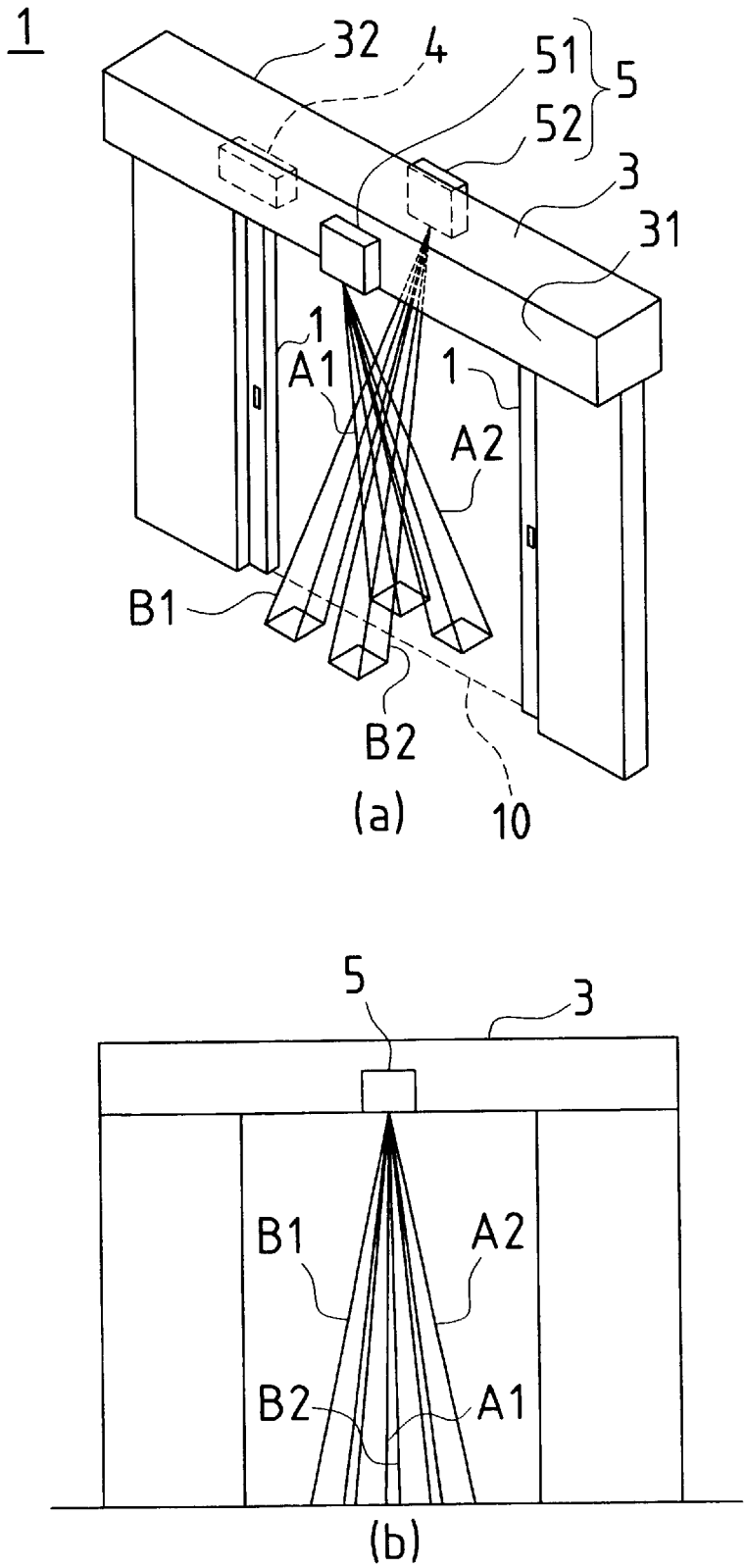
FIG. 5(*a*) is an illustration which shows an automatic door of a second embodiment and corresponds to that of FIG. 1.

FIG. 5(*a*) is an illustration which shows an automatic door concerning the second embodiment and which corresponds to that of FIG. 1. FIG. 5(*b*) is a front view of the automatic door. Similar to the first embodiment and as illustrated, the first auxiliary sensor 51 is disposed on the exterior side surface 31 of the transom 3, and its detection areas A1 and A2 are oriented from the exterior to the interior. Likewise, the second auxiliary sensor 52 is disposed on the interior side surface 32 of the transom 3, and its detection areas B1 and B2 are oriented from the interior to the exterior.

However, the detection areas A1 and A2 of the first auxiliary sensor 51 are not opposite to the detection areas B1 and B2 of the second auxiliary sensor 52 in a direction orthogonal to the extension direction of the track 10. Hence, at the doorway 2, the detection areas A1, A2 of the first auxiliary sensor 51 do not cross the detection areas B1, B2 of the second auxiliary sensor 52 in the front view. In terms of positional relationship, these detection areas establish a distorted relationship. In other words, the detection areas A1 and A2 of the first auxiliary sensor 51 and the detection areas B1 and B2 of the second auxiliary sensor 52 cross each other in a space vertically above the track 10, as viewed from the extension direction of the track 10. In addition, the detection areas A1 and A2 of the first auxiliary sensor 51 and the detection areas B1 and B2 of the second auxiliary sensor 52 are spaced side by side from each other, with a gap sufficiently smaller than the width dimension of a human body. Owing to this arrangement, when a person goes through the doorway 2, his/her body passes through at least one detection area of each of the auxiliary sensor 51 and the auxiliary sensor 52 together. As a result, detection signals are produced from both auxiliary sensors 51 and 52.

As described above and similar to the first embodiment, the sensor of this embodiment is also capable of determining whether an object (e.g. a person) is located on the track 10 or whether it is off the track 10 and situated in its vicinity, based on the transmission timing of the detection signals produced by the auxiliary sensors 51 and 52. According to the determination, the sensor controls the opening/closing action of the door segments 1.

Since the detection areas A1, A2, B1 and B2 are defined to not cross each other in the front view, it is possible to enlarge the width dimension of the whole detection area (see FIG. 5(*b*)). Thus, an object detection operation can be accurately performed, covering a wide area at the doorway 2 without increasing the number of detection areas A1, A2, B1 and B2.

Third Embodiment

The third embodiment also relates to modification of the detection areas to be covered by the auxiliary sensors 51 and 52. Hence, the description concentrates on the detection areas only.

Figure 6:
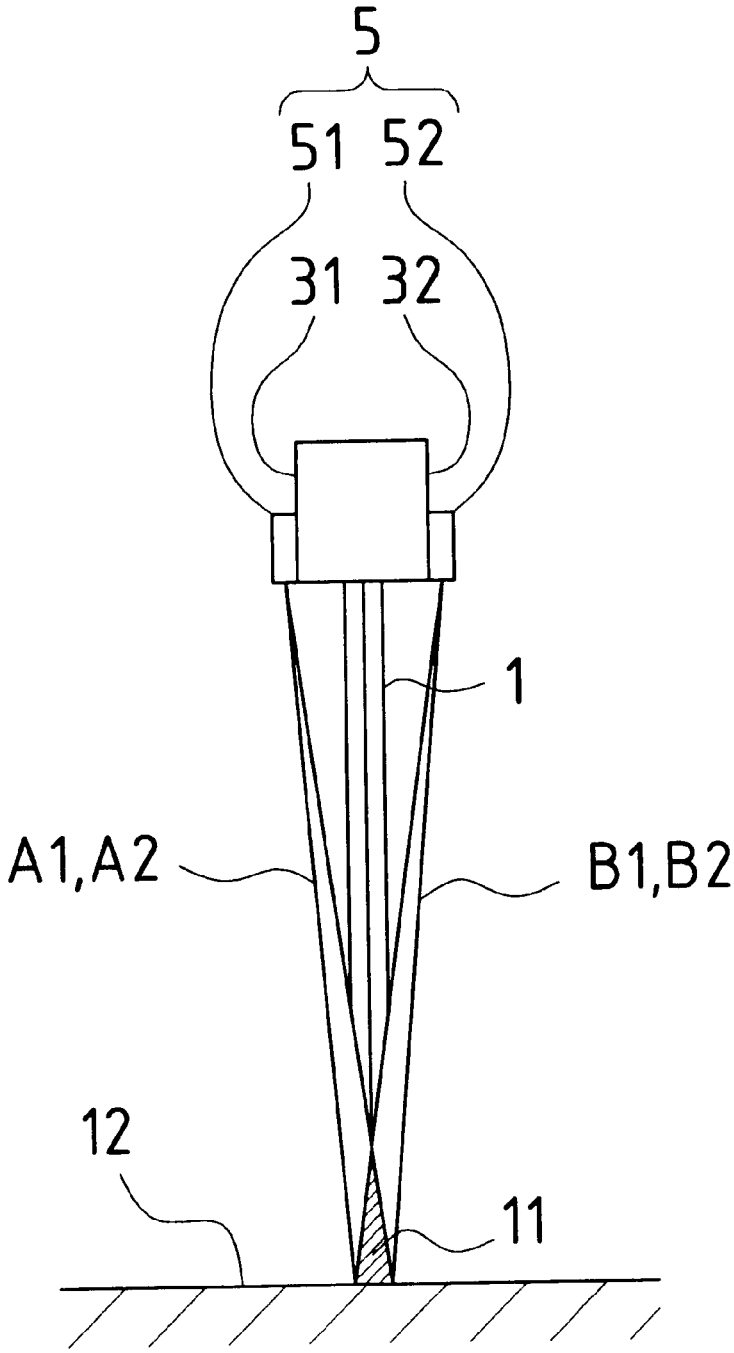
FIG. 6 is an illustration which corresponds to FIG. 2 and in of a third embodiment.

FIG. 6 is an illustration which corresponds to FIG. 2 and concerns the third embodiment. As illustrated, detection areas A1, A2, B1 and B2 of the auxiliary sensors 51 and 52 overlap each other on the track 10 on the floor 12. In FIG. 6, the cross areas 11 are indicated by shading.

According to this embodiment, an object detection operation can be performed without fail, even if an object passing through the doorway 2 has a relatively small height dimension.

Fourth Embodiment

Figure 7:
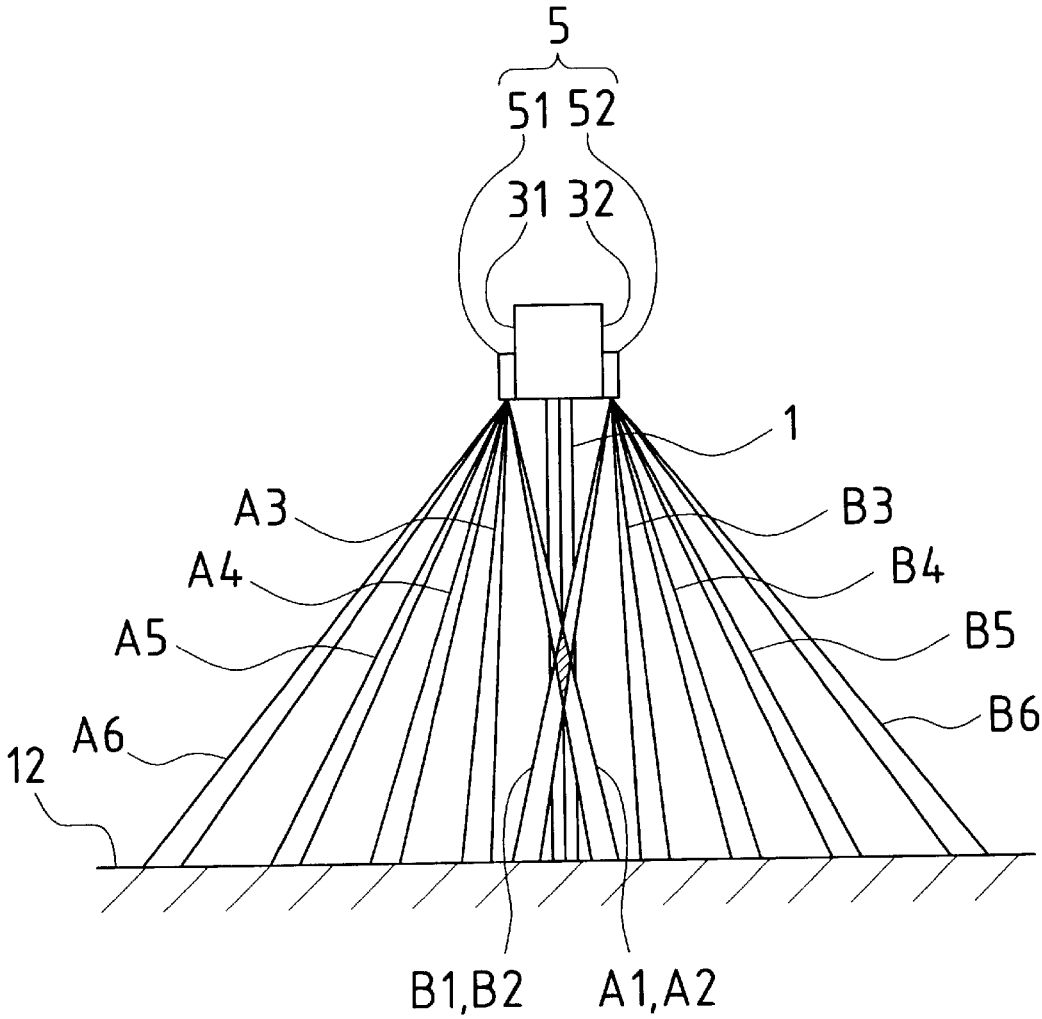
FIG. 7 is an illustration which corresponds to FIG. 2 and in of a fourth embodiment.
Figure 8:
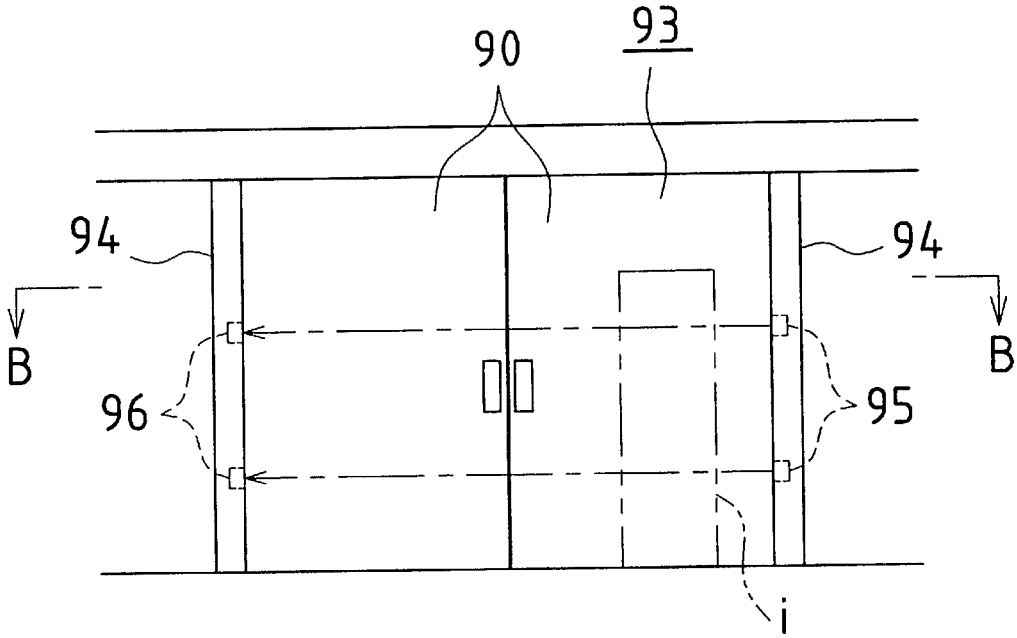
Fig.8 PRIOR ART
FIG. 8 relates to a first type of conventional auxiliary sensor, wherein FIG. 8(*a*) is a front view of an automatic door and FIG. 8(*b*) is a sectional view taken along the line B—B in FIG. 8(*a*).
Figure 8:
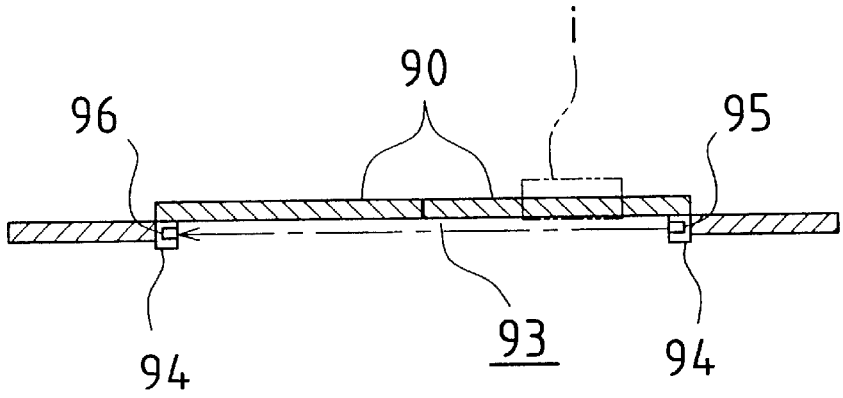
Fig.8 PRIOR ART
Figure 9:
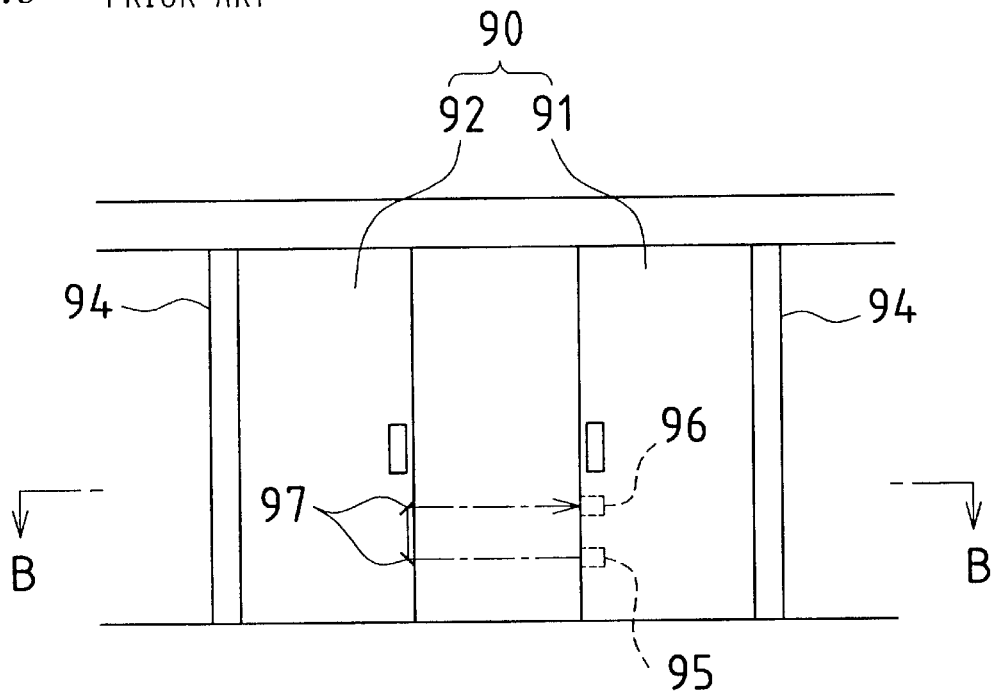
Fig.9 PRIOR ART
FIG. 9 relates to a second type of conventional auxiliary sensor, wherein FIG. 9(*a*) is a front view of an automatic door and FIG. 9(*b*) is a sectional view taken along the line B—B in FIG. 9(*a*).
Figure 9:
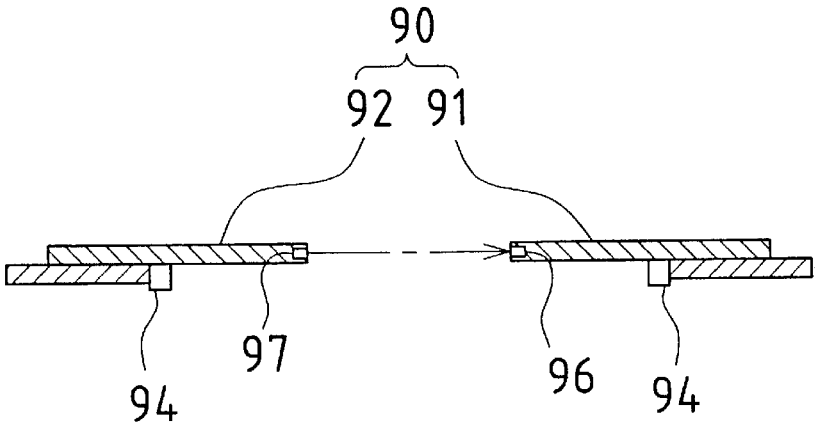
Fig.9 PRIOR ART
Figure 10:
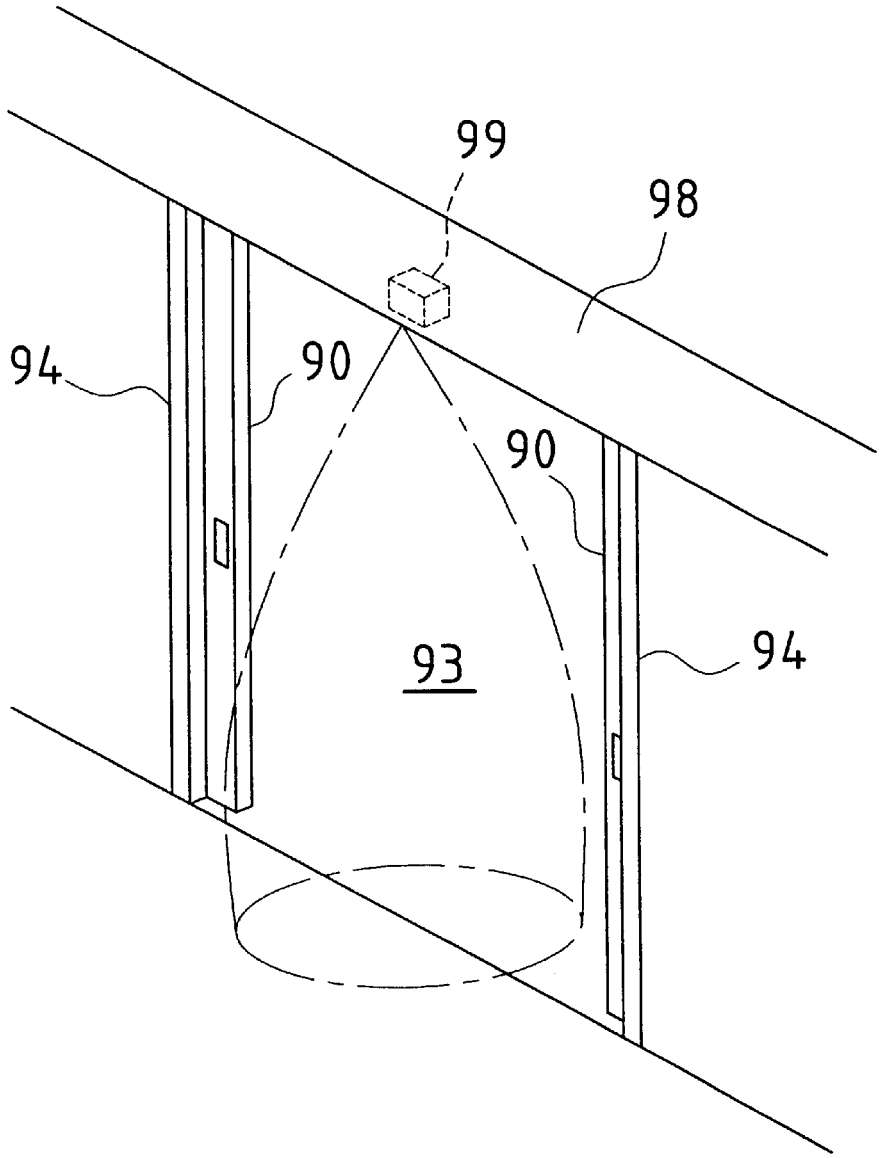
Fig.10 PRIOR ART
FIG. 10 relates to a third type of conventional auxiliary sensor.

In the fourth embodiment, the function of an activation sensor is combined in the auxiliary sensors 51 and 52. FIG. 7 is an illustration which corresponds to FIG. 2 but concerns the fourth embodiment. As illustrated, on the exterior and the interior of the doorway 2, optical systems provided in the auxiliary sensors 51 and 52 define detection areas A3–A6 and B3–B6 for door activation sensors, in addition to the detection areas A1, A2, B1 and B2 mentioned above. The detection areas A3–A6 and B3–B6 for door activation sensors are set in regions on the same side as the corresponding auxiliary sensors 51 and 52. Namely, those areas do not extend through the doorway 2.

When a person or the like enters any of the detection areas A3–A6 and B3–B6 for door activation sensors, an object detection signal is sent from the corresponding auxiliary sensor 51 or 52 to the automatic door controller 4 so as to keep the door segments 1 open. Similar to the first embodiment, this embodiment is arranged to cancel any detection signal related to the detection areas A1, A2, B1 and B2 which are defined in the vicinity of the track 10 if the door segments 1 are not in the open state.

According to this fourth embodiment, since each of the auxiliary sensors 51 and 52 also functions as an activation sensor, an automatic door no longer requires a separate activation sensor. Thus, this embodiment can simplify the structure of an automatic door, cut its production cost and facilitate its installation operation.

Incidentally, it should be appreciated that the present invention is applicable not only to bi-parting automatic doors, as mentioned in the above embodiments, but also to single-sliding automatic doors.

As for the detection areas, the above embodiments define the detection areas A1, A2, B1 and B2 at two locations arranged side by side in the extension detection of the track 10. However, the number of the detection areas are optional.

Further, each of the auxiliary sensors 51 and 52 may be disposed on a side surface of the transom 3, or, alternatively, on a bottom of the transom 3. In addition, each sensor means may be mounted on a ceiling surface if the transom is integrated into the ceiling surface.

The present application is based on Japanese Patent Application No. 2001-131187, the content of which is incorporated herein by reference. In addition, each document cited in this specification is incorporated herein by reference in its entirety.

What is claimed is:

1. An automatic door sensor which detects presence of an object on a track on an automatic door, comprising:

a pair of sensor means for detecting an object and producing an object detection signal if the object is located within detection areas of each of said pair of sensor means, which detection area is defined in a surrounding area of a doorway, wherein said detection areas of respective ones of said pair of sensor means partially cross each other on the track or in a space vertically above the track as viewed from an extension direction of the track; and a control means capable of receiving the object detection signal produced by each of said pair of sensor means for recognizing presence of the object on the track and maintaining the door in an open state only when said control means receives the object detection signal from both of said sensor means.

2. The automatic door sensor of claim 1, wherein said control means starts a door closing action if said control means receives the object detection signal from only one of said pair of sensor means uninterruptedly for a predetermined time.

3. The automatic door sensor of claim 2, wherein each of said pair of sensor means is disposed on a transom at the doorway and wherein the detection area of each of said pair of sensor means is defined by a region that extends from one side of the doorway, through the doorway, across the track and reaches a space on an other side of the door.

4. The automatic door sensor of claim 3, wherein the detection area of one of said pair of sensor means crosses the detection area of the other of said pair of sensor means as viewed from in front of the door.

5. The automatic door sensor of claim 3, wherein the detection area of one of said pair of sensor means does not cross the detection area of the other of said sensor means as viewed from in front of the door.

6. The automatic door sensor of claim 2, wherein the detection area of one of said pair of sensor means does not cross the detection area of the other of said sensor means as viewed from in front of the door.

7. The automatic door sensor of claim 2, wherein the detection area of one of said pair of sensor means crosses the detection area of the other of said pair of sensor means as viewed from in front of the door.

8. The automatic door sensor of claim 1, wherein the detection area of one of said pair of sensor means does not cross the detection area of the other of said sensor means as viewed from in front of the door.

9. The automatic door sensor of claim 1, wherein each of said pair of sensor means is disposed on a transom at the doorway and wherein the detection area of each of said pair of sensor means is defined by a region that extends from one side of the doorway, through the doorway, across the track and reaches a space on an other side of the door.

10. The automatic door sensor of claim 9, wherein the detection area of one of said pair of sensor means crosses the detection area of the other of said pair of sensor means as viewed from in front of the door.

11. The automatic door sensor of claim 9, wherein the detection area of one of said pair of sensor means does not cross the detection area of the other of said sensor means as viewed from in front of the door.

12. The automatic door sensor of claim 1, wherein the detection area of one of said pair of sensor means crosses the detection area of the other of said pair of sensor means as viewed from in front of the door.

13. An automatic door sensor for detecting presence of an object in a track of an automatic door, comprising:

a first sensor operable to detect an object and produce a first object detection signal, said first sensor having a first detection area that is defined within a surrounding area of a doorway of the automatic door;

a second sensor operable to detect an object and produce a second object detection signal, said second sensor having a second detection area that is defined within a surrounding area of the doorway of the automatic door;

wherein said first detection area and said second detection area partially cross each other on a track of the automatic door or in a space vertically above the track as viewed from an extension direction of the track; and a controller to receive the first object detection signal and the second object detection signal from said first sensor and said second sensor and to recognize presence of an object on the track and maintain the automatic door in an open state only when the controller receives both the first object detection signal and the second object detection signal.

14. The automatic door sensor of claim 13, wherein said controller is further operable to start a door closing action if said controller receives only one of the first object detection signal and the second object detection signal uninterruptedly for a predetermined time.

15. The automatic door sensor of claim 13, wherein said first sensor is disposed on a transom of the automatic doorway on one side of the automatic doorway and the first detection area is defined by a region that extends from the one side of the doorway, through the doorway, across the track and to a space on the other side of the doorway, and said second sensor is disposed on the transom of the automatic doorway on the other side of the automatic doorway and the second detection area is defined by a region that extends from the other side of the doorway, through the doorway, across the track and to a space on the one side of the doorway.

16. The automatic door sensor of claim 13, wherein the first detection area crosses the second detection area as seen in a direction from in front of the automatic door.

17. The automatic door sensor of claim 13, wherein the first detection area does not cross the second detection area as seen in a direction from in front of the automatic door.

* * * * *